United States Patent [19]

Isley

[11] 4,295,417

[45] Oct. 20, 1981

[54] WINDOW UNIT

[75] Inventor: Raymond H. Isley, Decatur, Ga.

[73] Assignee: Isley Window Manufacturing Co., Inc., Decatur, Ga.

[21] Appl. No.: 133,916

[22] Filed: Apr. 30, 1980

[51] Int. Cl.[3] ..... E06B 7/02

[52] U.S. Cl. ..... 98/88 R; 49/63; 98/90

[58] Field of Search ..... 98/88 R, 88 S, 90, 96, 98/98, 99, 99.1, 99.5, 99.6; 52/198, 206, 207; 49/61, 63, 67

[56] References Cited

U.S. PATENT DOCUMENTS

| | | | |
|---|---|---|---|
| 355,904 | 1/1887 | Abrahamson | 98/88 R |
| 1,136,784 | 4/1915 | Fair | 98/90 X |
| 1,360,698 | 11/1920 | Vorbroker | 98/98 |
| 3,077,011 | 2/1963 | Boucher | 98/88 R X |

FOREIGN PATENT DOCUMENTS

| | | | |
|---|---|---|---|
| 2702214 | 7/1978 | Fed. Rep. of Germany | 98/96 |
| 5383 | 1/1906 | France | 98/88 R |

*Primary Examiner*—Albert J. Makay
*Assistant Examiner*—Harold Joyce
*Attorney, Agent, or Firm*—James A. Hinkle

[57] ABSTRACT

A thermal window with insulating and noise reduction properties is provided with double glazing that has a large dead air space between the glazing. The top and bottom of the dead air space is divided into compartments which are shuttered by sliding glass panels that may be selectively positioned to allow a variety of air exchange conditions within the window unit.

3 Claims, 9 Drawing Figures

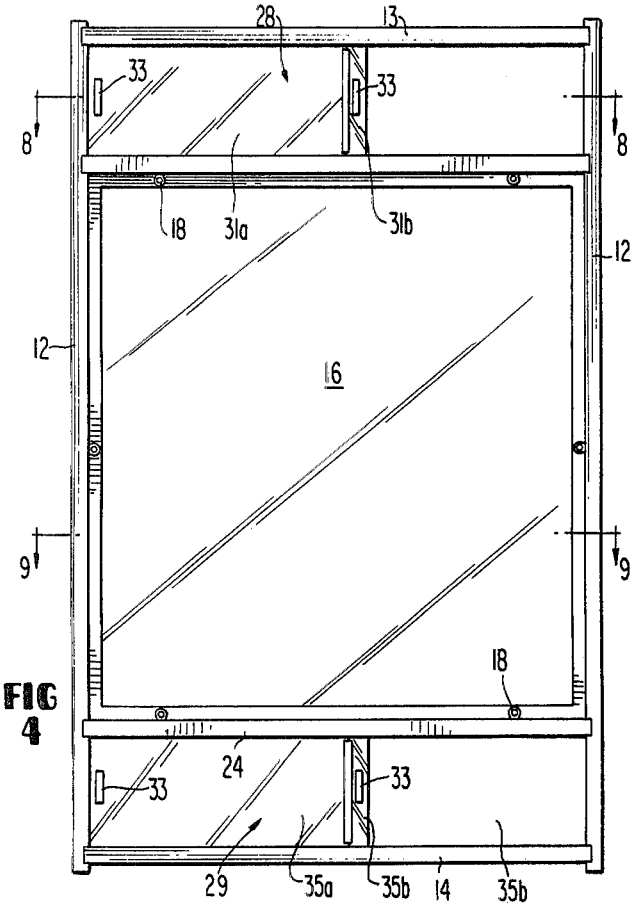
FIG 4
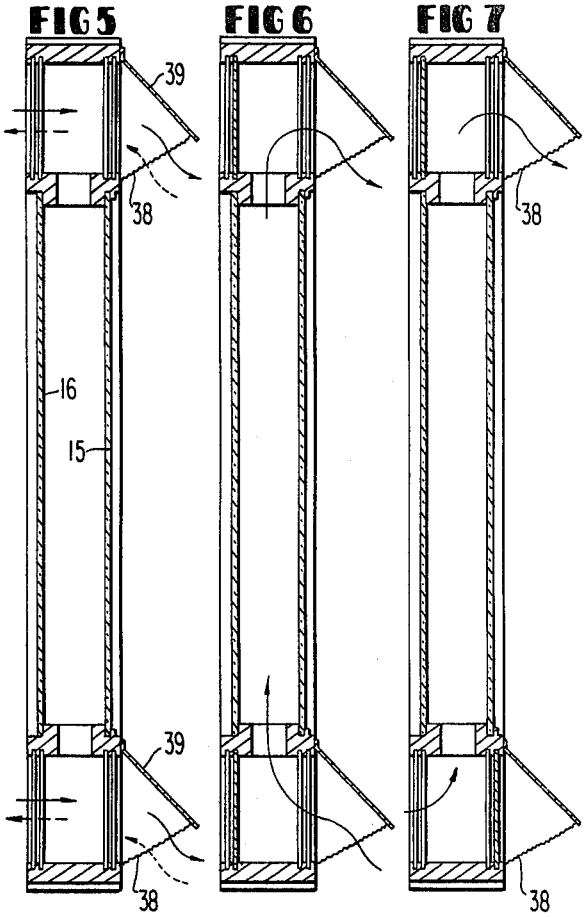
FIG 8
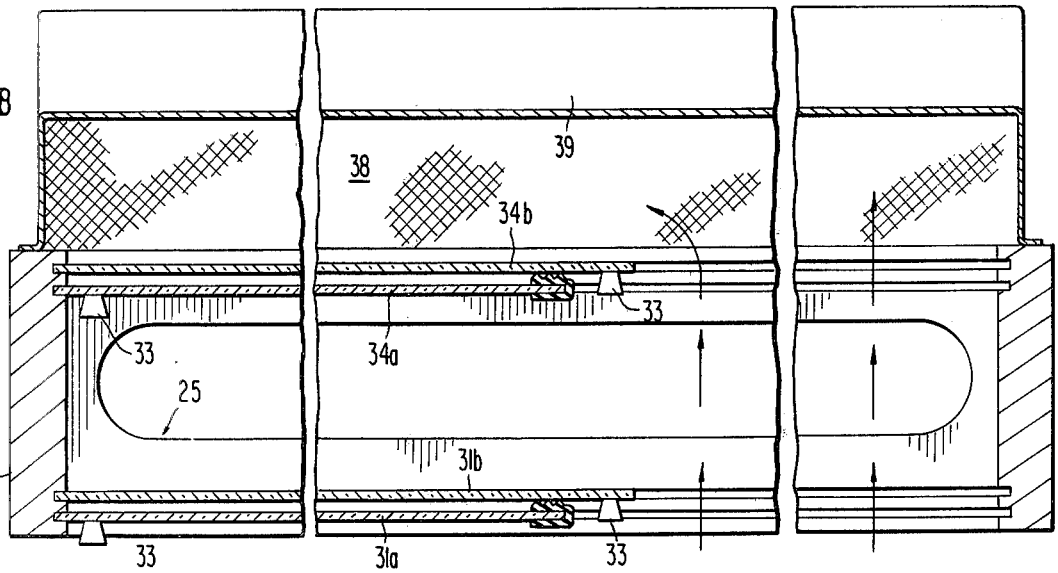
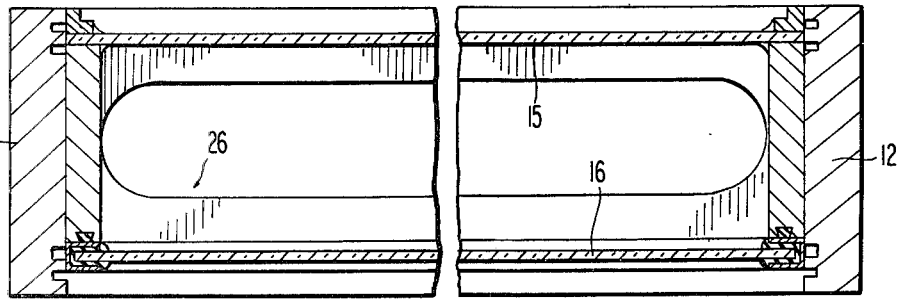
FIG 9

WINDOW UNIT

BACKGROUND OF THE INVENTION

The present invention relates to a new and improved construction of a thermal window having thermal insulating properties and noise reduction properties.

As is well known in times of high energy costs it is of primary importance in the construction of buildings to incorporate systems that provide the lowest energy costs.

In prior art windows, a single glazed unit does not offer any particular thermal insulating value or noise reduction properties. It has been long evident that in winter environments this type of window unit, or door unit for that matter, exhibits "sweating properties" which are harmful to the unit. The sweating is in fact condensation on the interior, or warm side of the unit, caused by a differential in temperature and humidity within the building. Such single glazed units do not offer circulation of the ambient air within the building in situations which would dictate that such a use would be immiently helpful.

Even in prior art double glazed window and door units, there is normally no provision made for circulation of the ambient air and the typical type of unit has a relatively low insulating resistance value (R). In addition, such prior art units are relatively expensive.

SUMMARY OF THE INVENTION

The present invention seeks to eliminate the problems of the prior art window and door units, and to provide a unit having superior effectiveness in the areas of noise reduction and thermal air circulation capabilities.

Another object of the invention is the provision of a thermal window unit having the capability to increase the circulation of ambient air within a building without the aid of any separate air moving system.

The present invention also provides an improved construction of a window or door unit having the capability of making a significant reduction of noise as compared to prior air units.

The invention also has a important object in that the principles involved can be applied to glass door units as well as glass window units to give the same beneficial effects to buildings which have suffered from the inadequacies of units known to the prior art.

Other objects and advantages of the invention will be apparent to those skilled in the art from the following detailed description of the preferred embodiment.

DESCRIPTION OF THE DRAWINGS

FIG. 4 is an overall front elevation view of the window unit contemplated by the invention;

FIG. 5 is a vertical section view of the window unit showing the transfer of the ambient air when both top and bottom sliding panels are opened;

FIG. 6 is a vertical section view of the window unit showing the air transfer condition when the interior panels are closed and the exterior panels are opened to allow warm air transfer from the bottom of the window out through the top of the window and the exterior;

FIG. 7 is a vertical section view of the window unit showing the air transfer condition when the interior panels are closed and the exterior panels are opened to allow air transfer from top to bottom of the unit and thence to the outside;

FIG. 8 is a horizontal section view taking along the lines 7—7 of FIG. 4; and FIG. 9 is a horizontal section view taking along the lines 8—8 of FIG. 4.

DETAILED DESCRIPTION OF THE PREFERRED EMBODIMENT

Figure 1:
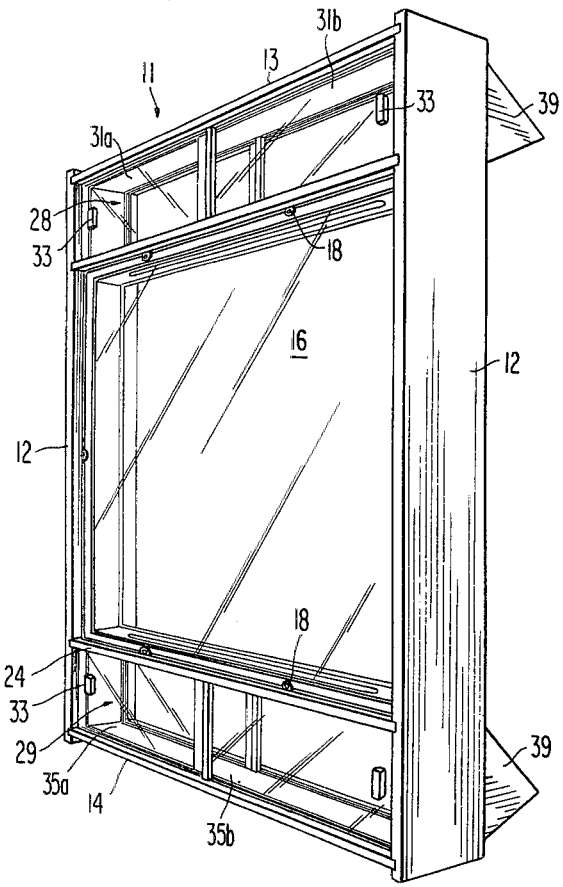
FIG. 1 is a elevation view in perspective showing a window unit constructed in the mode contemplated by the present invention.
Figure 2:
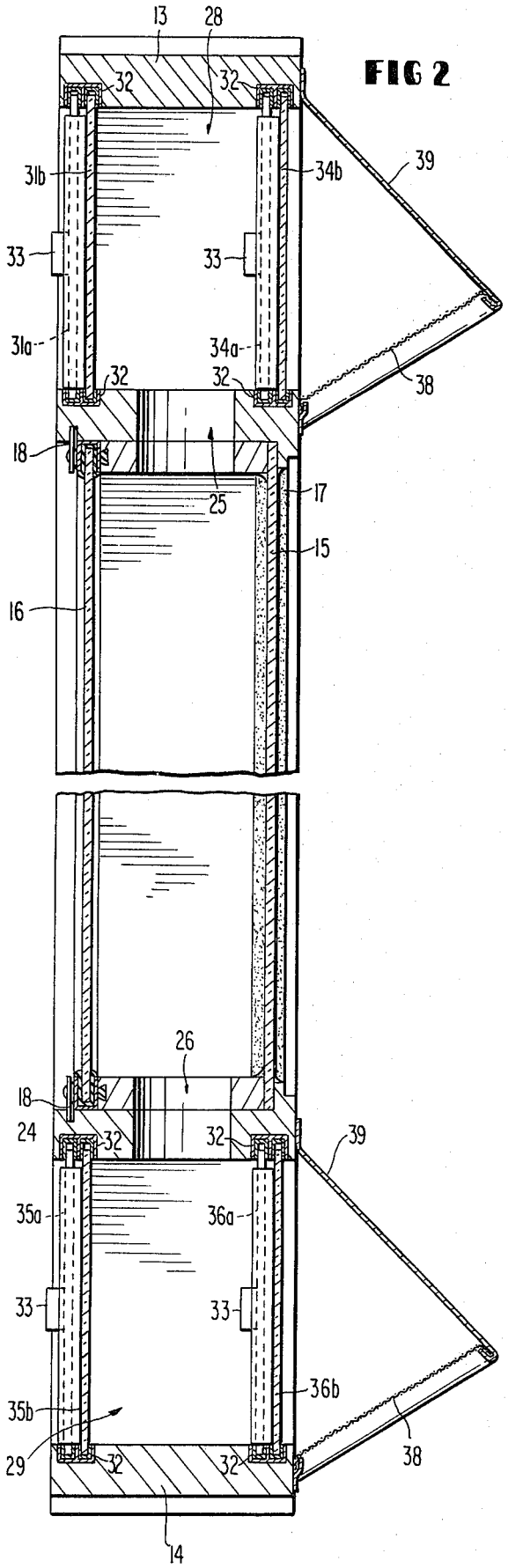
FIG. 2 is a vertical section view of the entire window unit of the present invention.

Referring now to the drawings, wherein like numerals designate corresponding parts throughout the several Figures, FIG. 1 shows a typical thermal window unit construction in accordance with the concepts of the present invention. The window 11 generally comprises a box like frame having side members 12, a top member 13 and bottom member 14 which together comprise the unitized structure which maintains the unit as a rigid unitary structure.

Figure 3:
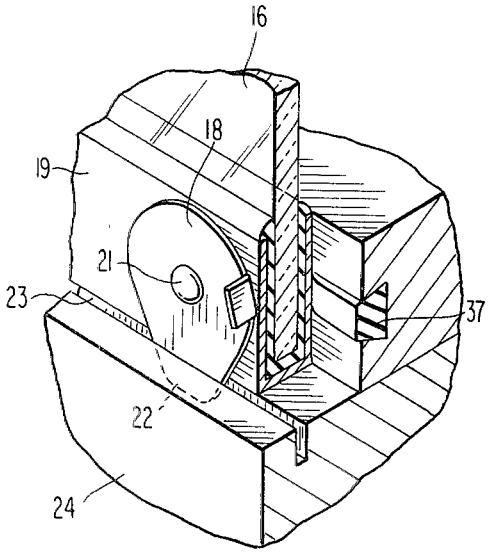
FIG. 3 is a partial perspective view of one embodiment of a locking device which may be used to lock the interior glass panel into the window frame.

The window 11 has within the frame, an outside pane 15 and an inside pane 16. The panes 15 and 16, while contemplated to be of glass, could consist of other materials such as the several types of plastics which are utilized in such environments. However, in this particular invention it is contemplated that glass will be utilized throughout and the discussion herein will be directed to that end. It is contemplated that the outside pane 15 will be fixed within the frame of the window unit 11 and not normally removable except for replacement. To that end, molding 17 is provided around the periphery of the pane 15 to maintain it in the unit. The inside pane 16 is contemplated to be removable for ease of cleaning of the interior of both panes. Many types of fasteners are known in the art to maintain such removable glass panes within a window unit and I have, at this point, shown in FIG. 3 a typical type of fastener 18 which would be permanently affixed to the channel holder 19 which surrounds the periphery of the inside glass pane 16. It is anticipated that the fastener 18 would be mounted on a pivot to the channel holder 19 and would be elongated in shape so that upon pivoting around pivot point 21 the locking tip 22 would rotate into engagement with the slot 23 which is cut into the bottom sill 24. As can be easily seen in FIG. 1 a plurality of fasteners 18 are provided to the inside pane 16 so that it can be effectively mounted within the window 11 and easily removed for cleaning. As noted, the type of fastener is shown here for explanation only and it is contemplated that any number of suitable fasteners might be substituted.

Of importance to the present invention is the provision within the window of a top and bottom air transfer apertures 25 and 26, respectively. As is evident, the top air transfer aperture 25 is cut into the top sill 27 while the bottom air transfer aperture 26 is cut into the bottom sill 24. The location of apertures 25 and 26 within the window unit are more readily seen in FIGS. 8 and 9.

An especially important aspect of this invention is the means by which the unit of the invention is capable of increasing circulation of ambient air within a building without the use of air moving systems. The present unit has integral therewith, an upper air compartment 28 and a lower air compartment 29. The upper air compartment 28 comprises a pair of sliding glass panels **31*a*** and 31*b* mounted within a felt lined aluminum guide member 32 positioned within the respective top member 13 and top sill 27 thereby providing a raceway within which the sliding glass panels 31*a* and 31*b* may slide horizontally with respect to one another. Each of the sliding glass panels 31*a* and 31*b* have a operating knob 33 by which the sliding glass panels 31*a* and 31*b* are moved horizontally by the operator.

Similar to the interior sliding glass panels 31*a* and 31*b*, there are at the top of the window unit exterior sliding glass panels 34*a* and 34*b*. These sliding glass panels 34*a* and 34*b* also have an operating knob 33 on each of them for ease of movement by the operator. In addition, the sliding glass panels 34*a* and 34*b* are positioned for horizontal sliding movement relative to one another in a felt lined aluminum guide member 32 as was previously described.

Similarly to the sliding glass panels at the top of the window unit, there are located at the bottom of the unit to control the lower air compartment 29, sets of sliding glass panels 35*a* and 35*b* for controlling the interior of the lower air compartment 29 and sliding glass panels 36*a* and 36*b* for controlling the exterior of the lower air compartment 29. In all respects as described for the sliding glass panels that control the upper air compartment 28, the panels just described for the lower air compartment 29 are identical in that they slide horizontally relative to one another and each separate panel has an operating knob 33 for ease of operation. In addition, the sets of panels 35*a*, 35*b* and 36*a*, 36*b* are positioned in a felt lined aluminum guide 32. Not only does the felt lined aluminum guide 32 provide means for maintaining the sliding glass panels in operative relation to one another and with the window unit, the felt lined aluminum guide 32 also provides insulating qualities to prevent infiltration of air around the panels themselves. Another means for preventing air infiltration through the inside pane 16 is the provision of an insulating strip 37 which is embedded into the side and top members 12 and 13, respectively, against which the inside pane 16 makes operative engagement when it is fixedly in place thereby preventing infiltration of air around the channel holder 19.

To prevent insects from entering the building and to prevent the rain from infiltrating the window unit from the exterior, certain preventive means are provided. First, there is a screen 38 mounted exteriorly of both exterior sliding glass panels 34*a* and 34*b* and exterior sliding glass panels 36*a* and 36*b*. This screen is preferably mounted against the frame of the window unit 11 so that it does not interfere with the easy operation of the sliding glass panels. Secondly, each of the air compartments 28 and 29 on the exterior thereof are provided with an awning 39 which is generally affixed to the frame of the window unit in such a fashion as to prevent the easy infiltration of moisture. It is anticipated that the awning may be of any conveniently manufactured material but in the embodiment described herein it is anticipated that the small awning 39 will be manufactured out of aluminum.

In operation it can be seen that the window unit of the present invention is quite flexible in its operating characteristics. For instance, the window offers several combinations by which the venilating principle embodied herein may be utilized. If it is desired to effect standard circulation as in any window, it is obvious that the sliding glass panel in the upper air compartment 28 may be opened thus giving straight through circulation at the upper part of the window. Similarly, the lower air compartment 29 may be also operated in a like manner by opening the interior and exterior sliding glass panels 35*a*, 35*b* and 36*a*, 36*b*. In the manner just described, standard circulation as with any window may be effected with the added feature of having the openings shielded against rain and other weather extremities. Obviously, with all of the sliding glass panels being shut and sealed the window offers superior insulating qualities over those shown in the prior art, inasmuch as the entire space between outside pane 15 and inside pane 16 constitutes a dead air space giving a relatively large 'R' factor as compared to even double glazed windows of the prior art. It is really the insulating qualities of this window which set it apart from the prior art and the particular way which the features of this window may be utilized to effect savings in heating and cooling costs of the building in which the window is used.

THERMAL ANALYSIS AND THERMAL EFFECTIVENESS

A protype of the window of the present invention was subjected to extensive engineerng tests which determined its thermal effectiveness. In conducting the tests, it was assumed that the transfer of heat energy is generally considered to take place through three process, either singly or in combination. Two of these processes apply directly to the window unit of the present invention. The first process is conduction which is the transfer of heat energy from one part of a body to another part or from one body to another body by short range inter-reactions of molecules. The second process is convection which is the transfer of energy by the combined mechanisms of fluid, fluid mixing and conduction.

The tested window was of the type shown and described herein and had a main thermal section, that being the area which is glass enclosed, of 1,088 cubic inches or 0.629 cubic feet. The window as tested possessed adjustable vents above and below the main thermal section and these adjustable vents were assigned the values of 0.083 cubic feet for both the maximum intake coefficient and maximum exhaust coefficient. Lastly a value for adjusted available space for ambient convection currents, which would include that volume which is taken up by the apertures separating the top vent from the bottom vent was assigned the value of 0.878 cubic feet. During the test, thermal conductivities for ambient air were assumed as 32.0 for temperature in degrees fahrenheit and 0.014 for thermal conductivity. These values were used throughout where a value for temperature or a thermal conductivity was required for calculations. In addition, the calculation of ambient air through the window unit was considered a function of thermal conductivity of the component parts of the window as well as the convection currents of the air within the window panes. Further consideration was given to the effect of the overall size of the window on its ability to circulate the ambient air.

FIG. 6 shows one mode of operation of the window unit and illustrates the tested thermal principal of the convection circulation characteristics of the invention, whereas, the warm air is rising due to thermal activity. FIG. 6 shows a state of condition wherein the upper air and lower air compartments 28 and 29 have their interior sliding glass panels 31*a*, 31*b* and 35*a*, 35*b* closed to the interior of the building and exterior sliding glass panels 34*a*, 34*b* and 36*a*, 36*b* open to the exterior of the building.

Based on the calculation analysis for thermal effectiveness of the invention, it was shows that this particular window would circulate 263 cubic feet of ambient air given the temperature within the thermal section of the window of 80 degrees fahrenheit or greater. The time frame for this circulation of air would be five hours. Other factors influencing the maximum amount of circulated air would include the fact that the window and associated hardware would require ample sunlight in order to maintain the temperature minimum stated above. If these minimum time and temperature requirements are met or exceeded the minimum value of 263 cubic feet will definitely increase.

Based on thermal conductivity for aluminum, it was shown that if the window of the present invention was made of aluminum rather than wood the unit could circulate, for the same size as noted above, a minimum of 428 cubic feet of ambient air if given the same exposure time and temperature. This being the aluminum collects heat and passes it on to the surrounding air much better than in the case of wood.

In a particular test the window of the present invention was placed in a test cell of virtually air tight construction. A known source of heat was supplied by infrared lamps to one side of the window representing the side which would be exposed to the exterior of a building. After a two hour waiting period, in order that the system might reach a equilibrium state, temperature measurements were made. These temperature measurements were then averaged and were also taken with the sliding glass panels arranged in several positions. The results of the test were analyzed and correlated and appear as follows:

Tested

Condition Number One—In the first test all of the sliding glass panels were closed and the window was, in effect, in a sealed condition. The temperature inside the test cell was initially 32.4% cooler than that temperature outside the window. In 40 minutes the temperature inside the room in the vicinity of the window begin to rise slowly due to convection through the window, structural components and the conductivity of the air between the two glass panes.

Condition Number Two—With the inside vents closed, that being the upper and lower interior sliding glass panels 31*a*, 31*b* and 35*a*, 35*b*, the outside sliding glass panels 34*a*, 34*b* and 36*a*, 36*b* were opened. The temperature inside of the test cell was averaged within the vicinity of 29.7% cooler than that temperature outside the window and maintained this value with very little deviation (plus or minus 1.9%) with the increase in the testing time. This is mainly due to the fact that the warmed air tends to circulate through the window's outside sliding glass panels causing a moving fluid within the window's main thermal section. This moving ambient air fluid causes less convection in the inside pane of glass.

In both of the conditions shown above, the inside temperature, representing the interior of a building, remained cooler by an average of 31.05% than the temperature of the outside of the window. For example, if the outside temperature at the warmest point of a day was 98 degrees, then the inside temperature, due to the circulation action of the thermal window, would then be approximately 70 degrees fahrenheit. Based upon actual physical testing, it was determined that the thermal window unit of the present invention will maintain a differential temperature from 27.8% to 31.5% less than the temperature which exists on the exterior surfaces of the window. Further, based upon calculations and actual physical testing, the window of the present invention provides an insulation factor of the equivalent of R-3. This is compared to most double glazed windows in use at the present time which possess an insulating factor of R-2. Of course, single glazed windows offer an insulation factor of a substantially less value.

Noise Level Analysis

To test the window for its ability to reduce ambient noise levels, the invention was subject to both high and low frequency sound of known levels and distances. In one test a low frequency limit of 150 Hz was utilized with the high frequency limit of 6500 Hz. Within these limits the level of volume was preset at 70 db plus or minus 2 db at a distance of 20 feet from the window unit.

The actual sound reduction through the test window in the low frequency range amounted to 55.72%. The 70 db noise level was reduced to 31.0 db. The sound reduction in the high frequency noise range was 48.57% with the 70 db noise level being reduced to 36 db. It is generally known that standard windows, of the single glazed type, suppress noise levels in the range of 18%-20%. Therefore, the window of the present invention as compared to single glazed windows reduce noise levels approximately 63.56% as compared to standard single glazed windows.

It should be understood that the just described embodiment merely illustrates principles of the invention and a selected preferred form. Many additions, deletions and other modifications may, of course, be made thereto without departing from the spirit and scope of the invention as set forth in the following claims.

What is claimed is:

1. A window unit for a building comprising a peripheral frame, said window unit having a first facade in communication with exterior ambient air and a second facade in communication with interior ambient air, means within said frame defining multiple compartments stacked vertically one above the other, said multiple compartments comprising an upper compartment, a middle compartment and a lower compartment, said middle compartment comprising an exterior window pane and an interior window pane, said panes being spaced apart defining an air space therebetween, the upper and lower compartments being in communication with one another through the middle compartment, the upper and lower compartments having means for communication with the interior and exterior ambient air comprising a closure means in communication with the interior ambient air and a closure means in communication with the exterior ambient air, each of said closure means comprises a pair of horizontally sliding panels positioned for movement in track means and each panel being independently movable, means for preventing inclement weather from entering said upper and lower compartments comprising an awning structure mounted on the exterior facade above each of said upper and lower compartments, the interior window pane of the middle compartment being selectively removable from said frame.

2. A window unit for a building comprising a peripheral frame, said window unit having a first facade in communication with exterior ambient air and a second facade in communication with interior ambient air, means within said frame defining an upper compartment, a middle compartment, and a lower compartment, said compartments being in communication with one another, means for selectively opening and closing the upper and lower compartments comprising a closure in communication with the interior ambient air and a closure in communication with the exterior ambient air in both the upper and lower compartments, each of said closures comprising a pair of horizontally sliding panels positioned for movement in track means wherein each panel of said pair is selectively movable, said middle compartment comprising a fixed exterior window pane and an interior window pane, said panes being spaced apart defining an air space therebetween, means for preventing the entrance of inclement weather comprising an awning structure mounted on said window unit overhanging each of the upper and lower compartments.

3. A window unit as claimed in claim 2, wherein the middle compartment interior window pane is adopted to be removable from the second facade to facilitate access to the exterior window pane, clip means securing said removable pane to said second facade adapted to be selectively manipulated to effect removal of said pane from said facade.

* * * * *